United States Patent [19]

Soerens et al.

[11] Patent Number: 4,795,530

[45] Date of Patent: Jan. 3, 1989

[54] PROCESS FOR MAKING SOFT, STRONG CELLULOSIC SHEET AND PRODUCTS MADE THEREBY

[75] Inventors: Dave A. Soerens, Winnebago County; Linda K. H. Sauer, Calumet County; Gregory A. Wendt, Winnebago County, all of Wis.

[73] Assignee: Kimberly-Clark Corporation, Neenah, Wis.

[21] Appl. No.: 22,168

[22] Filed: Mar. 5, 1987

Related U.S. Application Data

[63] Continuation-in-part of Ser. No. 795,122, Nov. 5, 1985, abandoned.

[51] Int. Cl.[4] ..... D21H 5/24

[52] U.S. Cl. ..... 162/111; 162/112; 162/113; 162/158; 162/184; 162/186

[58] Field of Search ..... 162/111, 112, 113, 184, 162/186, 158

[56] References Cited

U.S. PATENT DOCUMENTS 3,014,832 12/1961 Donnelly ..... 162/184

3,556,931 1/1971 Champaigne ..... 162/184

FOREIGN PATENT DOCUMENTS

82/00485 2/1982 World Int. Prop. O. ..... 162/111

*Primary Examiner*—Peter Chin

*Attorney, Agent, or Firm*—Gregory E. Croft

[57] ABSTRACT

A process for making a soft, strong cellulosic sheet weighing from about 2 to about 15 pounds per 2880 sq. ft., comprising selectively treating a face surface of a cellulosic fibrous web with a dilute aqueous solution of a chemical debonding agent in an amount effective to soften a surface zone of the web proximate the treated face surface, whereby a composite strong zone/soft surface zone structure results, with the soft surface zone thereof including the treated face surface and being from about 10 to about 40% of the total thickness of the web, and with the strong zone being effectively untreated by the agent. The cellulosic sheet made by this process is characterized by a strong inner surface zone of from about 50 to about 90% of the total thickness of the sheet, and a soft and pleasing-to-the-touch outer surface zone comprising the remainder of the thickness of the sheet.

10 Claims, 1 Drawing Sheet

PROCESS FOR MAKING SOFT, STRONG CELLULOSIC SHEET AND PRODUCTS MADE THEREBY

This is a continuation-in-part of copending application Ser. No. 795,122 filed Nov. 5, 1985 now abandoned.

TECHNICAL FIELD

This invention relates to soft, strong cellulosic sheet having a soft outer surface zone and a strong inner surface zone, and a process of making such cellulosic sheets. The process of the invention produces cellulosic sheets that are exceedingly soft to the touch yet strong enough to withstand vigorous use.

DESCRIPTION OF THE BACKGROUND ART

Consumers of cellulosic sheet material such as tissue paper products have long been known to desire such products to feel soft. Another desired physical characteristic of tissue paper products is strength. Just as a strong tissue paper product that is hard, or unpleasing to the touch, is generally disfavored by consumers, so too are soft tissue paper products that lack sufficient strength. Therefore, for many years, there has been extensive research in the field of tissue papermaking to discover methods of producing soft yet strong cellulosic sheets. However, a recurring problem is that the physical phenomenon upon which the strength of cellulosic sheets depends—the formation of hydrogen bonds between adjacent fibers—is also the factor that detracts from the softness of such sheets.

One prior art method of imparting softness to cellulosic tissue paper sheets is to apply work to the sheets. For example, at the end of most conventional tissue papermaking processes, the sheets are removed from the surface of a thermal drying means, such as a Yankee drum, by creping them with a doctor blade. Such creping breaks many of the inter-fiber hydrogen bonds throughout the entire thickness of the sheet. However, simple creping produces tissue paper that is neither as soft nor as strong as is desirable.

The prior art therefore turned to treating cellulosic tissue paper sheets or their cellulosic web precursor, with chemical debonding agents that disrupt the inter-fiber hydrogen bonds. See, e.g., U.S. Pat. Nos. 4,144,122; 4,372,815; and 4,432,833.

For example, U.S. Pat. Nos. 3,812,000; 3,844,880; and 3,903,342 disclose the addition of chemical debonding agents to an aqueous slurry of cellulosic fibers. Generally, these agents are cationic quaternary amines such as those described in U.S. Pat. Nos. 3,554,862; 3,554,863; and 3,395,708. Other references disclose adding the chemical debonding agent to a wet cellulosic web. See, U.S. Pat. No. 2,756,647 and Canadian Pat. No. 1,159,694.

These methods have been found to suffer from a serious drawback. The addition by the prior art of the chemical debonding agent to an aqueous slurry of cellulosic fibers or to a cellulosic web with a high moisture content results in the distribution of substantial quantities of the chemical debonding agent throughout the entire thickness of the cellulosic tissue paper sheet. See, e.g., the paragraph bridging columns one and two of U.S. Pat. No. 2,756,647. This causes an unacceptable decline in the strength of the sheet. Furthermore, from the use of strong acids to acidify the chemical debonding agent, such as disclosed in Canadian Pat. No. 1,159,694, are derived environmental and economical drawbacks.

Another problem with chemical debonding agents in general, and cationic quaternary amines in particular, is that they substantially interfere with the adhesive/-release agent combination normally employed to obtain proper adhesion of the cellulosic web precursor to the Yankee drum thermal drying means.

In conventional tissue papermaking processes, a cellulosic web is formed; the web is subjected to non-thermal eewatering, such as by a series of vacuum boxes or vacuum pressure rolls; the dewatered web is adhered to a thermal drying means, such as a Yankee drum, and dried; and the dried web is creped from the surface of the Yankee drum by a doctor blade. Adhesion of the web to the Yankee drum/creping surface is accomplished by contacting the web with an adhesive that is usually sprayed upon that part of the rotating Yankee drum that is not yet in contact with the advancing web. Further, to the adhesive is usually added a release agent that prevents the web from adhering too strongly to the Yankee drum. The cationic quaternary amines that function as chemical debonding agents are known to act as release agents. Thus, the use of cationic quaternary amines as chemical debonding agents created release problems.

DESCRIPTION OF THE INVENTION

The process of the present invention overcomes the aforedescribed shortcomings of the prior art. The process successfully treats only a surface zone of from 10 to about 40% of the total thickness of a cellulosic web with a chemical debonding agent. As a cellulosic tissue paper web precursor typically is 5 to 7 fibers thick, the present process is surprisingly able to treat a surface zone that is a mere few fibers thick. The remainder of the web is effectively untreated by the chemical debonding agent. Thus, a cellulosic sheet made by the process of the present invention is characterized by a soft outer surface zone and a strong inner surface zone. Furthermore, the chemical debonding agent used in the present process need not be acidified as the unexpected results achieved by the process are derived by use of a dilute aqueous solution of the chemical debonding agents. Acidifying the chemical debonding agent yields no further advantages. Also, although the process of the present invention adds the chemical debonding agent in relatively close proximity to the thermal drying means/creping surface, little or no interference with the papermaking process is caused thereby.

These goals are achieved by the present process which is a method of making a soft, strong cellulosic sheet wherein, prior to the conventional tissue papermaking process step of adhering the dewatered web of cellulosic fibers to a thermal drying means and subjecting the web to thermal drying, the web is selectively treated on one face surface thereof with a dilute aqueous solution of a chemical debonding agent in an amount effective to soften a surface zone of the web proximate the treated face surface, whereby a composite strong zone/soft surface zone structure results, with the soft surface zone thereof including the treated face surface and being from about 10 to about 40% of the total thickness of the web, and with the said strong zone being effectively untreated by said agent.

The term "effectively untreated" as used herein means that the inter-fiber hydrogen bonds of that portion of the web that is outside the treated surface zone are substantially unaffected by the chemical debonding agent. The strength of that portion of the web that is not in the treated surface zone is therefore not significantly decreased by the disruption of the inter-fiber hydrogen bonds. That is, some of the hydrogen bonds in that portion of the web that is not in the treated zone may, in fact, be disrupted by the chemical debonding agent, but not a sufficient number are disrupted to have a significant adverse effect on the strength of such portion.

The present invention also includes a soft, strong cellulosic sheet comprising at least 2 plies, weighing from about 2 to about 15 pounds per 2880 sq. ft. per ply, and wherein the plies that comprise the two outer surfaces of the sheet comprise an outer surface zone that is from about 10 to about 40% of the total thickness of the outer surface ply, and an inner surface zone that is the remainder of the total thickness of the outer surface ply, the outer surface zone including a chemical debonding agent, and the inner surface zone being effectively untreated by the chemical debonding agent.

Other aspects of the present ineention, as well as a further appreciation of the present process, and the cellulosic sheets made thereby, will be gained from an examination of the following detailed description of preferred embodiments, taken in conjunction with the figures of drawing.

DETAILED DESCRIPTION OF THE PREFERRED EMBODIMENTS

In accordance with the present invention, a process is provided for making a soft, strong cellulosic sheet which is characterized by a strong inner surface zone of from about 60 to about 90% of the total thickness of the sheet, and a soft and pleasing-to-the-touch outer surface zone comprising the remainder of the thickness of the sheet. Accordingly, the present invention will now be described with reference to certain preferred embodiments. Those skilled in the art wil realize that such a description is meant to be exemplary only and should not be deemed limitative respecting the scope of the present invention.

Figure 1:
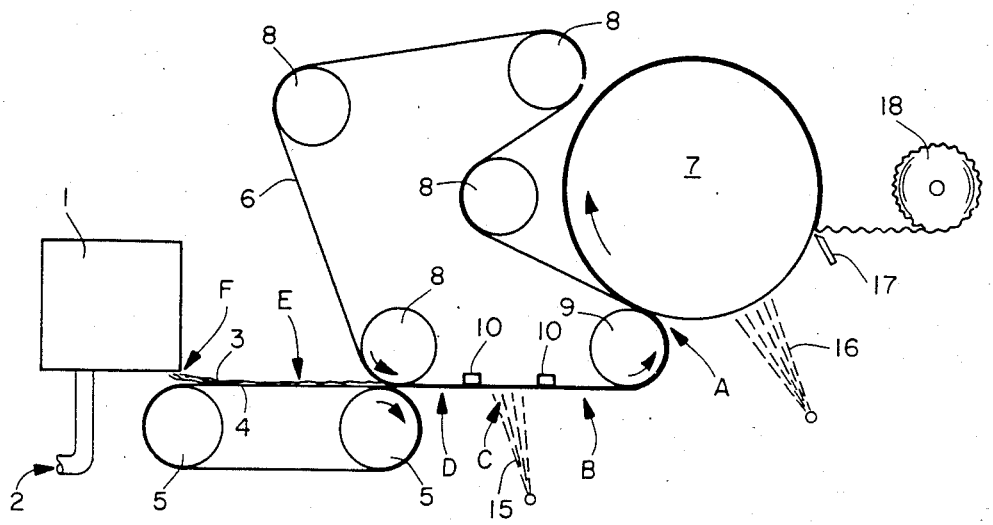
FIG. 1 is a schematic representation that depicts an apparatus which may be utilized to practice the process of the present invention.

A schematic representation that depicts an apparatus which can be employed to practice the process of the present invention is set forth in FIG. 1.

A headbox 1 is provided to hold a supply of fiber furnish, which generally comprises a dilute slurry of cellulosic papermaking fibers and water. The fiber furnish 2 is transported to the headbox at a level sufficient to permit the formation upon completion of the papermaking process of a substantially dry tissue paper sheet that is generally about 5 to 7 fibers thick.

A web 3 is formed by deposition of the aqueous furnish onto a foraminous web forming means 4 or forming wire, through which a major portion of the furnish water is drained. The forming wire is supported and driven on a continuous path by two guide rolls 5, at least one of which is driven by a drive means (not shown).

The partially dewatered web is transferred to a papermaking felt 6 which serves to further dewater the web and in turn transfer it to the surface of thermal drying means 7. The felt 3 is carried on a continuous path by a plurality of guide rolls 8 and pressure roll 9. Between the forming wire and the pressure roll, the web is subjected to further dewatering by at least one vacuum device, such as vacuum boxes 10. The vacuum boxes also serve to dewater the felt. Prior to eeaching the dryer surface and prior to at least one of the vacuum boxes, the surface zone of the web is treated with a dilute aqueous solution of a chemical debonding agent 15. Treatment of the web with the debonding agent can be performed by any of the various means known to those skilled in the art. Application by spray nozzle is preferred. Of most significance for purposes of this invention, however, is the fact that at least one of the vacuum boxes serves to pull the sprayed debonding agent into the web to penetrate from about 10% to 40% of the total thickness of the web. The presence of some sort of vacuum device at this point is essential to achieve and control the proper penetration of the debonding agent.

With regard to the location of the debonder spray application, points C and D are preferred points for treatment of the surface zone of web 1 with the chemical debonding agent. However, the process of the present invention includes such treatment at any point of the papermaking process after the web leaves the forming wire and before thermal drying, wherein treatment of the web by the proper amount of chemical debonding agent results in a sheet that exhibits a composite strong zone/soft surface zone structure. For example, if the pressure roll 9 were a vacuum suction roll, point B could also be suitable. The actual moisture content of the web when treated may vary. Thus the fiber consistency may be in the range of from 10 to about 50% based on the bone dry fiber weight. However, in any event, points A, E, and F are not suitable. At point A, the debonding agent does not sufficiently penetrate the web and therefore only acts as a release agent. At points E and F, the ultimate penetration of the debonding agent is too great and cannot be controlled, usually resulting in too much debonding and loss of web tensile strength.

The chemical debonding agent utilized may be any of those known to the artisan. Preferred chemical debonding agents include cationic quaternary amines available from Armak Chemicals, Inc., Chicago, Ill., under the tradenames Arquad 2HT-75 and Armosoft L; Quaker Chemicals of Barrington, Ill., under the tradename Quaker 2008; Reilly-Whiteman, Inc. of Conshohocken, Pa. under the tradename Ricofax 618; and General Mills Inc., Chemical Division, Kankake,, Ill., under the tradename Aliquat 11226.

The chemical debonding agent used to treat the web is applied as a dilute aqueous solution usually at ambient temperature. The amount of chemical debonding agent used is that amount that is sufficient to deplete the hydrogen bonds in the surface zone of the web, but less than the amount that would cause problems with the strength of the cellulosic tissue paper sheet being made. The amount of chemical debonding agent to be used is a solution of the agent which provides from about 0.5 to about 4.0, preferably 0.5 to 1.5 and most preferably 1.0 pounds of chemical debonding agent per ton of cellulosic sheet. The application rate of the dilute aqueous solution of the chemical debonding agent may be calculated by methods well known to the artisan to achieve the desired chemical debonding agent solids concentration in the cellulosic sheet product.

After treatment with the chemical debonding agent, the web is applied to the surface of the dryer, such as a Yankee dryer, to which adhesive 16 has been applied to facilitate adhesion of the web to the surface. Any conventional adhesive may be employed, including polyvinyl alcohol and soluble natural polymers, etc. The web is then dried to a moisture content typically in the range of from 3–8% by weight, based on the bone dry fiber weight. The dried cellulosic web is dislodged from the dryer in a conventional manner with a creping means, such as a doctor blade 17, and thereafter wound up as a softroll 18 for subsequent converting.

The cellulosic web or sheet made by the process of the present invention preferably weighs from about 2 to about 15 pounds per 2880 sq. ft. per ply and is characterized by a soft outer surface zone that is from about 10 to about 40% of the total thickness of the sheet, or, typically, about 1–3 fiber diameters thick, and a strong inner surface zone that is the remainder of the sheet.

Thus the process of the present invention comprises making a soft, strong cellulosic sheet weighing from about 2 to about 15 pounds per 2880 sq. ft., the method comprising selectively treating a face surface of a cellulosic fibrous web with a dilute aqueous solution of a chemical debonding agen in the amount effective to soften a surface zone of the web proximate the treated face surface, whereby a composite strong zone/soft surface zone structure results, with the soft surface zone thereof including the treated face surface and being from about 10 to about 40% of the total thickness of the web, and with the strong zone being effectively untreated by the agent. The consumer products made by the process of the present invention are cellulosic sheets comprising at least two plies, each ply preferably weighing from about 2 to about 15 pounds per 2880 sq. ft. Regardless of how many plies are employed, the plies that comprise the two outer surfaces of the sheet are plies that have been made by the process of the present invention, arranged such that the soft outer surface zones of each outer surface ply are the outermost portions of the sheet.

Figure 2:
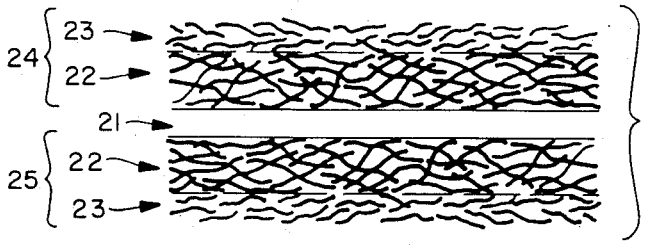
FIG. 2 is a schematic representation of a two ply embodiment of the cellulosic sheet of the present invention.

A two ply sheet is depicted in FIG. 2. As shown, there is a void 21 between the two plies 24 and 25. Each ply comprises a strong inner surface zone 22 that has been effectively untreated by the chemical debonding agent, and a soft outer surface zone 23 that is from about 10 to about 40% of the total thickness of plies 24 and 25, and which contains the chemical debonding agent in an amount of from about 0.5 to about 4.0 pounds per ton of the ply. It should be noted that a typical ply in a product such as depicted in FIG. 2 is 5 to 7 fibers thick, such that strong inner surface zone 22 is about 2 to about 4 fibers thick, while the soft outer surface zone is from about 1 to about 3 fibers thick.

An evaluation of the thickness of the soft surface zone of the sheet of the present invention may begin with a microscopic analysis of the sheet or a determination of the nitrogen content derived from the chemical debonding agent in each zone of the composite structure produced by the process of the present invention. Based on microscopic analysis of sheet actually produced by the present process, it is estimated that from about 10 to about 40% of the thickness of the sheet is treated by the chemical deboding agent while the remainder of the sheet is effectively untreated. Various consumer products might require various ranges within this broad range such that the soft surface zone may comprise from about 30 to about 40%; from about 10 to about 30%; from about 20 to about 40%; from about 10 to about 20%; and from about 20 to about 30% of the total thickness of the web.

The following examples are illustrative of the method and the products of the present invention. These examples are intended to describe specific embodiments of the method and of the products of the present invention and are not intended to delineate in any way the limits of the present invention or the scope of the claims.

EXAMPLE 1

Cellulosic tissue paper sheet was produced on an apparatus such as depicted in FIG. 1, using a 50/50 mixture of long and short fiber (northern softwood Kraft/eucalyptus) with 0.25% of a wet strength resin added. The dryer basis weight of the tissue paper was 7.4 pounds per 2880 sq. ft. Referring to FIG. 1, a spray boom was variously located at points C, E, and F. The fiber consistency of the web, based on the bone dry fiber weight, was estimated to be less than 50% at each point. The spray boom consisted of a rod to which air atomizing nozzles were attached.

Samples of cellulosic tissue paper shee were made with application to the sheet at points C, E, and F of a chemical debonding agent Quaker 2008, so as to achieve a concentration of approximately 1 pound of chemical debonding agent per ton of sheet.

The cellulosic tissue paper sheets were subsequently evaluated for softness and strength. Softness was evaluated by a sensory panel which compaeed the tactile properties of the sheets to various standards. A difference of 0.2–0.3 in softness is significant. The strength of the sheets was calculated, as is well known to those in the art, by the invariant tensile strength T which is equal to the square root of the product of the machine direction tensile strength (Tmd) and the cross-directional tensile strength (Tcd). The results were as follows:

| Sheet Treated At Position | Softness | T = Tmd × Tcd (grams) |
|---|---|---|
| C (Invention) | 8.1 | 843 |
| E (Comparison) | 7.6 | 674 |
| F (Comparison) | 8.0 | 671 |

Thus, treating the web at positions E and F results in a sheet that is over 20% weaker than a sheet produced in accordance with the process of the present invention. Furthermore, the sheet produced by a process where the treatment with the chemical debonding agent occurs is point E is significantly less soft than the sheet produced in accordance with the present invention. It should be noted that point E corresponds to the treatment location disclosed in Canadian Pat. No. 1,159,694.

While not desirous of being constrained to any particular theory, it is surmised that at points E and F debonding occurs uniformly throughout the web. The depletion of hydrogen bonds in the interior of the web adversely affects the strengt of the web. The superior softness of the sheets of the present invention is believed to stem from the unexpected localization of the chemical debonding agent in the outer surface zone of the sheet, a zone that is only a few fibers thick.

EXAMPLE 2

The process described in Example 1 was repeated except that the spray boom was located at point C, just before the final vacuum box 10. Softness, stiffness, surface depth, and abrasiveness were evaluated by a sensory panel. The invariant tensile strength was calculated as in Example 1.

| | Pounds of Chemical Debonding Agent Per Ton of Sheet Produced | | |
|---|---|---|---|
| | 0 (Control) | 1.0 | 3.0 |
| T (grams) | 920 | 982 | 944 |
| Softness | 7.7 | 8.65 | 8.85 |
| Stiffness | 5.1 | 4.2 | 4.15 |
| Surface Depth | 6.1 | 6.65 | 6.9 |
| Abrasiveness | 3.0 | 2.8 | 2.7 |

From this data it may be seen that the various sheets made in accordance with the invention exhibit superior strength and far superior softness to the control. The decrease in stiffness of the sheets of the present invention as compared to the control suggests that the chemical debonding agent is not acting as a release agent and thereby interfering with creping. Such a result is surprising considering the close proximity of the application point to the thermal drying means. From microscopic analysis it is estimated that the soft surface zone of the sheets herein produced are from about 10 to about 40% of the total thickness of the sheet.

EXAMPLE 3

The process as described in Example 1 was repeated except that the spray boom was located at points B and C to illustrate the effect of the vacuum box location relative to the debonder application. In both cases, 3.0 pounds of debonding agent (Armosoft L) were applied to the web. As a control, 3.0 pounds of water only were applied at points B and C. The results are summarized as follows:

| | Control (Average) | Point B | Point C |
|---|---|---|---|
| T (grams) | 827 | 960 | 787 |
| Softness | 8.5 | 7.9 | 8.6 |
| Stiffness | 4.2 | 5.1 | 4.1 |
| Surface Depth | 6.4 | 6.4 | 6.3 |

This data illustrates the "release" effect of applying the debonding agent too close to the pressure roll nip without subsequent contact with a vacuum suction means. Note that the strength and stiffness increase at the B poisition relative to the control, which is indicative of poor creping. However, at the C position, there is a reduction in stiffness compared to the control with only a slight change in strength. Softness also increased slightly. Application of the debonding agent at point A would result in even larger effects relative to point C.

In all of the foregoing examples, the application of the debonding agent at point C resulted in the formation of a soft surface zone being from about 10 to about 40% of the total thickness of the web, with the remaining strong zone of the web being effectively untreated by the debonding agent.

While the invention has been described in terms of various preferred embodiments, the skilled artisan will appreciate that various modifications, subtitutions, omission, and changes may be made without departing from the spirit thereof. Accordingly, it is intended that the scope of the present invention be limited solely by the scope of the following claims.

We claim:

1. In a process for making a soft, strong cellulosic tissue sheet wherein a web of cellulosic fibers is formed on a forming wire and thereafter adhered to the surface of a drying means and creped, the improvement comprising treating one face surface of the web with a dilute aqueous solution of a chemical debonding agent in an amount effective to soften a surface zone of said web proximate said treated face surface and thereafter, prior to being adhered to the surface of the drying means, subjecting the web to vacuum suction whereby a composite strong zone/soft surface zone structure results, with said soft surface zone thereof including said treated face surface and being from about 10 to about 40% of the total thickness of said web, and with said strong zone being effectively untreated by said agent.

2. The process of claim 1 wherein said soft surface zone of said web is treated with an aqueous solution of said chemical debonding agent which provides from about 0.5 to about 4.0 pounds of said agent per ton of said cellulosic sheet.

3. The process of claim 1 wherein said soft surface zone of said web is treated with a solution of said chemical debonding agent which provides from about 0.5 to about 1.5 pounds of said agent per ton of said cellulosic sheet.

4. The process of claim 1 wherein said chemical debonding agent comprises at least one cationic quaternary ammonium compound.

5. The process of claim 1 wherein said soft surface zone of said web is treated with a solution of said chemical debonding agent which provides about 1 pound of said agent per ton of said cellulosic sheet.

6. The process of claim 1 wherein said soft surface zone comprises from about 20 to about 40% of the total thickness of said web.

7. The process of claim 1 wherein sai soft surface zone comprises from about 30 to about 40% of the total thickness of said web.

8. The process of claim 1 wherein said soft surface zone comprises from about 10 to about 30% of the total thickness of said web.

9. The process of claim 1 wherein said soft surface zone comprises from about 10 to about 20% of the total thickness of said web.

10. The process of claim 1 wherein said soft surface zone comprises from about 20 to about 30% of the total thickness of said web.

* * * * *